US008003289B2

(12) United States Patent
Wu

(10) Patent No.: US 8,003,289 B2
(45) Date of Patent: Aug. 23, 2011

(54) FERROCENE CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 693 days.

(21) Appl. No.: 12/129,965

(22) Filed: May 30, 2008

(65) Prior Publication Data

US 2009/0297965 A1 Dec. 3, 2009

(51) Int. Cl.
*G03G 5/047* (2006.01)

(52) U.S. Cl. ..... 430/58.8; 430/58.05; 430/58.75; 430/59.1; 430/59.4

(58) Field of Classification Search ..... 430/58.8, 430/58.05, 58.75, 59.4
See application file for complete search history.

(56) References Cited

U.S. PATENT DOCUMENTS

| | | | | |
|---|---|---|---|---|
| 4,265,990 | A | 5/1981 | Stolka et al. | |
| 4,587,189 | A | 5/1986 | Hor et al. | |
| 5,350,653 | A * | 9/1994 | Shoshi et al. | 430/58.35 |
| 5,354,635 | A * | 10/1994 | Itami et al. | 430/59.5 |
| 5,464,717 | A * | 11/1995 | Sakaguchi et al. | 430/59.4 |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 2004/0126685 | A1 * | 7/2004 | Horgan et al. | 430/58.3 |
| 2006/0210897 | A1 * | 9/2006 | Jubran et al. | 430/77 |
| 2009/0297232 | A1 | 12/2009 | Wu | |
| 2009/0297961 | A1 | 12/2009 | Wu | |
| 2009/0297962 | A1 | 12/2009 | Wu | |
| 2009/0297963 | A1 | 12/2009 | Wu et al. | |
| 2009/0297964 | A1 | 12/2009 | Wu | |
| 2009/0297966 | A1 | 12/2009 | Wu | |
| 2009/0297967 | A1 | 12/2009 | Wu | |
| 2009/0297969 | A1 | 12/2009 | Wu | |

OTHER PUBLICATIONS

Jin Wu et al., U.S. Appl. No. 11/869,231 on Additive Containing Photogenerating Layer Photoconductors, filed Oct. 9, 2007.
Jin Wu et al., U.S. Appl. No. 11/869,246 on Phosphonium Containing Photogenerating Layer Photoconductors, filed Oct. 9, 2007.
Jin Wu et al., U.S. Appl. No. 11/869,252 on Additive Containing Charge Transport Layer Photoconductors, filed Oct. 9, 2007.
Jin Wu et al., U.S. Appl. No. 11/869,258 on Imidazolium Salt Containing Charge Transport Layer Photoconductors, filed Oct. 9, 2007.
Jin Wu et al., U.S. Appl. No. 11/869,265 on Phosphonium Containing Charge Transport Layer Photoconductors, filed Oct. 9, 2007.
Jin Wu et al., U.S. Appl. No. 11/869,269 on Charge Trapping Releaser Containing Charge Transport Layer Photoconductors, filed Oct. 9, 2007.
Jin Wu et al., U.S. Appl. No. 11/869,279 on Charge Trapping Releaser Containing Photogenerating Layer Photoconductors, filed Oct. 9, 2007.
Jin Wu, U.S. Appl. No. 11/869,284 on Salt Additive Containing Photoconductors, filed Oct. 9, 2007.
Liang-Bih Lin et al., U.S. Appl. No. 11/800,108 on Photoconductors, filed May 4, 2007.
Liang-Bih Lin et al., U.S. Appl. No. 11/800,129 on Photoconductors, filed May 4, 2007.

* cited by examiner

*Primary Examiner* — Christopher Rodee
*Assistant Examiner* — Jonathan Jelsma
(74) *Attorney, Agent, or Firm* — Oliff & Berridge, PLC

(57) ABSTRACT

A photoconductor that includes, for example, a supporting substrate, a photogenerating layer, and at least one charge transport layer comprised of at least one charge transport component, and wherein at least one of the photogenerating layer and charge transport layer contains a ferrocene.

26 Claims, No Drawings

FERROCENE CONTAINING PHOTOCONDUCTORS

CROSS REFERENCE TO RELATED APPLICATIONS

Copending U.S. application Ser. No. 12/129,958, U.S. Publication No. 20090297964 on Anthracene Containing Photoconductors, filed May 30, 2008, the disclosure of which is totally incorporated herein by reference.

Copending U.S. application Ser. No. 12/129,969, U.S. Publication No. 20090297966 on Amine Phosphate Containing Photogenerating Layer Photoconductors, filed May 30, 2008, the disclosure of which is totally incorporated herein by reference.

Copending U.S. application Ser. No. 12/129,943, U.S. Publication No. 20090297961 on Phenol Polysulfide Containing Photogenerating Layer Photoconductors, filed May 30, 2008, the disclosure of which is totally incorporated herein by reference.

Copending U.S. application Ser. No. 12/129,977, U.S. Publication No. 20090297967 on Phosphonate Hole Blocking Layer Photoconductors, filed May 30, 2008, the disclosure of which is totally incorporated herein by reference.

Copending U.S. application Ser. No. 12/129,948, U.S. Publication No. 20090297962 on Aminosilane and a Self Crosslinking Acrylic Resin Hole Blocking Layer Photoconductors, filed May 30, 2008, the disclosure of which is totally incorporated herein by reference.

Copending U.S. application Ser. No. 12/129,982 on Zirconocene Containing Photoconductors, filed May 30, 2008, the disclosure of which is totally incorporated herein by reference.

Copending U.S. application Ser. No. 12/129,952, U.S. Publication No. 20090297963 on Backing Layer Containing Photoconductor, filed May 30, 2008, the disclosure of which is totally incorporated herein by reference.

Copending U.S. application Ser. No. 12/129,989, U.S. Publication No. 20090297969 on Polymer Anticurl Backside Coating (ACBC) Photoconductors, filed May 30, 2008, the disclosure of which is totally incorporated herein by reference.

Copending U.S. application Ser. No. 12/129,995, U.S. Publication No. 20090297232 on Polyimide Intermediate Transfer Components, filed May 30, 2008, the disclosure of which is totally incorporated herein by reference.

U.S. application Ser. No. 11/869,231 filed October 9, 2007, entitled Additive Containing Photogenerating Layer Photoconductors, the disclosure of which is totally incorporated herein by reference, illustrates a photoconductor comprising a supporting substrate, a photogenerating layer, and at least one charge transport layer comprised of at least one charge transport component, and wherein the photogenerating layer contains at least one of an ammonium salt and an imidazolium salt.

U.S. application Ser. No. 11/869,246 filed Oct. 9, 2007, entitled Phosphonium Containing Photogenerating Layer Photoconductors, the disclosure of which is totally incorporated herein by reference, illustrates a photoconductor comprising a supporting substrate, a phosphonium salt containing photogenerating layer, and at least one charge transport layer comprised of at least one charge transport component.

U.S. application Ser. No. 11/869,252 filed Oct. 9, 2007, entitled Additive Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the charge transport layer contains at least one ammonium salt.

U.S. application Ser. No. 11/869,258 filed Oct. 9, 2007, entitled Imidazolium Salt Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein at least one charge transport layer contains at least one imidazolium salt.

U.S. application Ser. No. 11/869,265 filed Oct. 9, 2007, entitled Phosphonium Containing Charge Transport Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the at least one charge transport layer contains at least one phosphonium salt.

U.S. application Ser. No. 11/869,269 filed Oct. 9, 2007, entitled Charge Trapping Releaser Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the at least one charge transport layer contains at least one charge trapping releaser.

U.S. application Ser. No. 11/869,279 filed Oct. 9, 2007, entitled Charge Trapping Releaser Containing Photogenerating Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the photogenerating layer contains at least one charge trapping releaser component.

U.S. application Ser. No. 11/869,284 filed Oct. 9, 2007, entitled Salt Additive Containing Photoconductors, the disclosure of which is totally incorporated herein by reference, illustrates a photoconductor comprising a supporting substrate, a photogenerating layer, and at least one charge transport layer comprised of at least one charge transport component, and wherein at least one of the photogenerating layer and the charge transport layer contains at least one of a pyridinium salt and a tetrazolium salt.

In U.S. application Ser. No. 11/800,129 entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the photogenerating layer contains a bis(pyridyl)alkylene.

In U.S. Application No. 11/800,108 entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the charge transport layer contains a benzoimidazole.

BACKGROUND

This disclosure is generally directed to imaging, such as xerographic imaging and printing members, photoreceptors, photoconductors, and the like. More specifically, the present disclosure is directed to drum, multilayered drum, and flexible, belt imaging members, or devices comprised of a supporting medium like a substrate, a photogenerating layer, and a charge transport layer, including a plurality of charge transport layers, such as a first charge transport layer and a second charge transport layer, and wherein at least one of the photogenerating layer and charge transport layer contains as an additive or dopant a ferrocene, and a photoconductor comprised of a supporting medium like a substrate, a ferrocene containing photogenerating layer, and a ferrocene containing charge transport layer that results in photoconductors with a number of advantages, such as in embodiments, minimal charge deficient spots (CDS); the minimization or substantial elimination of undesirable ghosting on developed images, such as xerographic images, including acceptable ghosting at various relative humidities; excellent cyclic and stable electrical properties; compatibility with the photogenerating and charge transport resin binders; and acceptable lateral charge migration (LCM) characteristics, such as for example, excellent LCM resistance and on line control, and adjustment of the photoconductor photosensitivity. At least one in embodiments refers, for example, to one, to from 1 to about 10, to from 2 to about 6; to from 2 to about 4; 2, and the like.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source. Moreover, the photoconductors disclosed herein are in embodiments useful in high resolution color xerographic applications, particularly high-speed color copying and printing processes.

In embodiments, the ferrocene additive is dissolved in the photogenerating solvent, such as tetrahydrofuran, and subsequently the resulting mixture can be added to the appropriate photoconductor layer, such as the photogenerating layer, on line with simple mixing since the additive is soluble in THF, thereby tuning the PIDC, that is, adjusting the PIDC slower when a fast or rapid PIDC is observed on line. Similarly, the ferrocene additive is dissolved in the (SMTL) solvent, such as methylene chloride, and can be readily added into the SMTL solution, especially the first pass SMTL solution, on line with simple mixing since the additive is soluble in solvents like methylene chloride, permitting tuning the PIDC, that is, adjusting the PIDC slower when a fast or rapid PIDC is observed on line. For example, the ferrocene included in the photogenerating layer resulted in an about 30 volt change in the PIDC, and similarly with the ferrocene containing charge transport layer the change in PIDC was about 40 volts.

The ferrocene additive or dopant, which can be incorporated into the photogenerating layer, and which dopant functions, for example, to passivate the photogenerating pigment surface by, for example, blocking or substantially blocking intrinsic free carriers, and preventing or minimizing external free carriers from attracting to the pigment surface, and thereby permitting photoconductors with minimal CDS (charge deficient spots), the control of PIDC, for example controlling, and more specifically, slowing the PIDC, especially in those situations where the photosensitivity of the photoconductor can be adjusted on line and automatically, to a desired preselected value or amount, and which photosensitivity can be increased or decreased; and acceptable LCM characteristics, such as for example, acceptable lateral charge migration (LCM) resistance. Similarly, the ferrocene additive can be incorporated into the charge transport layer, and in embodiments there can be accomplished the on line and automatic addition of the ferrocene to this layer.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in numerous U.S. patents, such as U.S. Pat. No. 4,265,990, wherein there is illustrated an imaging member comprised of a photogenerating layer, and an aryl amine hole transport layer.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and more specifically, about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are photoconductors that contain a dopant in the photogenerating layer, or charge transport layer, and where there are permitted acceptable photoinduced discharge (PIDC) values, excellent lateral charge migration (LCM) resistance, and excellent cyclic stability properties.

Additionally disclosed are flexible belt imaging members containing optional hole blocking layers comprised of, for example, amino silanes, (throughout in this disclosure plural also includes nonplural, thus there can be selected a single amino silane), metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

In embodiments, there is disclosed a photoconductor comprising a supporting substrate, a photogenerating layer, and at least one charge transport layer comprised of at least one charge transport component, and wherein at least one of the photogenerating layer and the charge transport layer contains a ferrocene or mixtures of ferrocenes; a photoconductor comprised in sequence of a photogenerating layer, and at least one charge transport layer; and wherein the charge transport layer includes a ferrocene containing compound; and a photoconductor comprising a supporting substrate, a photogenerating layer, and a charge transport layer, and wherein the photogenerating layer is comprised of at least one photogenerating pigment component and a ferrocene containing component.

Aspects of the present disclosure relate to a photoconductor comprising a supporting substrate, a photogenerating layer, and at least one charge transport layer comprised of at least one charge transport component, and where the photogenerating layer contains at least one photogenerating component and the additive or dopant as illustrated herein; a photoconductor comprising a supporting substrate, a ferrocene containing photogenerating layer, and a ferrocene containing charge transport layer comprised of at least one charge transport component; a photoconductor comprised in sequence of an optional supporting substrate, a hole blocking layer, an adhesive layer, a ferrocene containing photogenerating layer, or a ferrocene containing charge transport layer; a photoconductor wherein the charge transport component is an aryl amine selected from the group consisting of N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and mixtures thereof; and wherein the at least one charge transport layer is from 1 to about 4; a photoconductor wherein the photogenerating pigment is a hydroxygallium phthalocyanine, a titanyl phthalocyanine, a halogallium phthalocyanine or a perylene; a photoconductor wherein the ferrocene is present in at least one of the charge transport layer and photogenerating layer in an amount of, for example, from about 1 to about 1,000, from about 50 to about 600, and from about 150 to about 300 parts per million; a photoconductor wherein the ferrocene is present in at least one of the charge transport layers in an amount of, for example, from about 1 to about 500, from about 10 to about 200, and from about 20 to about 50 parts per million; a photoconductor wherein the ferrocene is present in the photogenerating layer in an amount of, for example, from about 10 to about 1,000, from about 50 to about 600, and from about 150 to about 300 parts per million; a photoconductor wherein the substrate is comprised of a conductive material, and a flexible photoconductive imaging member comprised in sequence of a supporting substrate, photogenerating layer thereover, a charge transport layer, and a protective top overcoat layer; a photoconductor which includes a hole blocking layer and an adhesive layer where the adhesive layer is situated between the hole blocking layer and the photogenerating layer, and the hole blocking layer is situated between the substrate and the adhesive layer; and a photoconductor wherein the additive or dopant can be selected in various effective amounts, such as for example, from about 0.001 to about 0.1 weight percent.

Additive/Dopant Examples

Examples of the photogenerating and charge transport additive or dopant include, for example, a number of known suitable components, such as ferrocenes.

In embodiments, the ferrocenes selected are comprised of two cyclopentadienyl (Cp) or substituted cyclopentadienyl anions bound to an iron center in the oxidation state II.

Ferrocene examples included in at least one of the photogenerating layer and charge transport layer can be represented by the following structures/formulas

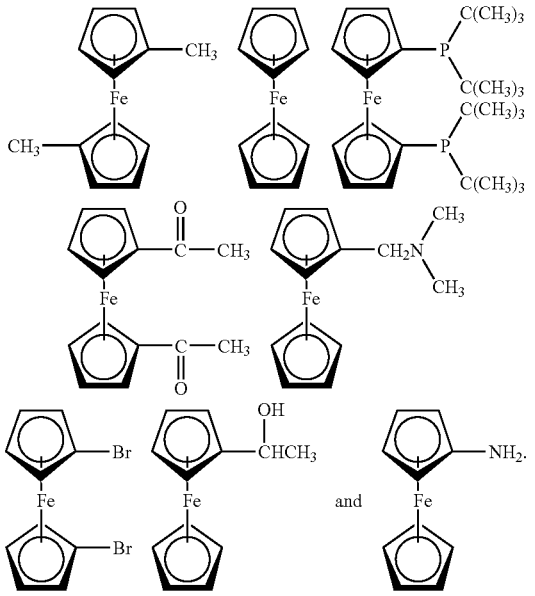

In embodiments, examples of ferrocene additives for the photogenerating layer, the charge transport layer, or both the photogenerating layer and the charge transport layer or charge transport layers are 1,1'-dimethylferrocene, ferrocene, 1,1'-bis(di-tert-butylphosphino)ferrocene, 1,1'-diacetylferrocene, N,N-dimethylaminomethylferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, tert-butylferrocene, and the like, and mixtures thereof.

In embodiments, the ferrocene is present in at least one of the charge transport layer and photogenerating layer in an amount of, for example, from about 1 to about 1,000, from about 50 to about 600, from about 5 to about 200, from about 100 to about 250, from about 150 to about 300, from about 100 to about 200, from about 150 to about 250, from about 50 to about 200, from about 100 to about 400, and from about 75 to about 200 parts per million. In another embodiment, the ferrocene is present in at least one of the charge transport layer in an amount of, for example, from about 1 to about 500, from about 10 to about 200, and from about 20 to about 50 parts per million. Yet in another embodiment, the ferrocene is present in the photogenerating layer in an amount of, for example, from about 10 to about 1,000, from about 50 to about 600, and from about 150 to about 300 parts per million.

Photoconductive Layer Components

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

The thickness of the photoconductor substrate layer depends on many factors, including economical considerations, electrical characteristics, adequate flexibility, availability and cost of the specific components for each layer, and the like, thus this layer may be of substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of substantial thickness of, for example, up to many centimeters or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

The photogenerating layer can be specifically comprised of a high sensitivity titanyl phthalocyanine component generated by the processes as illustrated in copending application U.S. application Ser. No. 10/992,500, U.S. Publication No. 20060105254, the disclosure of which is totally incorporated herein by reference.

Examples of photogenerating layer binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly (vinyl carbazole), and the like. These polymers may be block, random, or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer or layers for the imaging members of the present disclosure can contain a number of components including known hole blocking components, such as amino silanes, doped metal oxides, a metal oxide like titanium, yttrium, cerium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 to about 65 weight percent of a suitable component like a metal oxide, such as $TiO_2$, from about 20 to about 70 weight percent, and more specifically, from about 25 to about 50 weight percent of a phenolic resin; from about 2 to about 20 weight percent and, more specifically, from about 5 to about 15 weight percent of a phenolic compound preferably containing at least two phenolic groups, such as bisphenol S, and from about 2 to about 15 weight percent, and more specifically, from about 4 to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 30 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 15 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of titanyl phthalocyanines, or oxytitanium phthalocyanines are suitable photogenerating pigments that absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene, to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The process of the referenced copending application further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

Typically, flexible photoreceptor belts are fabricated by depositing the various layers of photoactive coatings onto lengthy webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise, and thereafter transversely cut into predetermined lengths to form photoreceptor sheets of precise dimensions that are eventually welded into belts. The web length in a coating run may be many thousands of feet long and the coating run may take more than an hour for each layer.

Charge transport layer components and molecules include a number of known materials as illustrated herein, such as aryl amines, which layer is generally of a thickness of from about 5 to about 75 microns, and more specifically, of a thickness of from about 10 to about 40 microns. Examples of charge transport components can be represented by at least one of

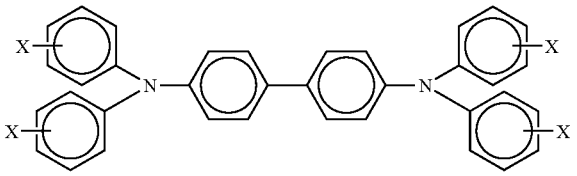

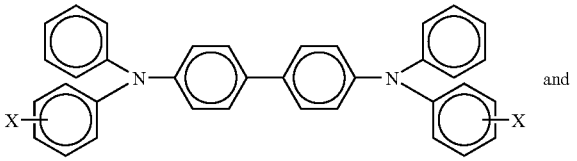

and

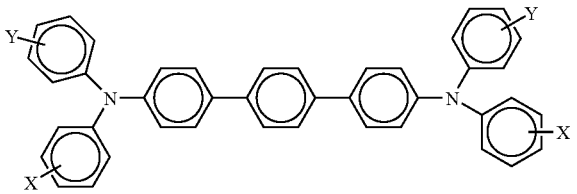

wherein X and Y are at least one of hydrogen, alkyl, alkoxy, aryl, and substituted derivatives thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific charge transport components include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylpheny)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Disclosed specific examples of charge transport components are represented by at least one of

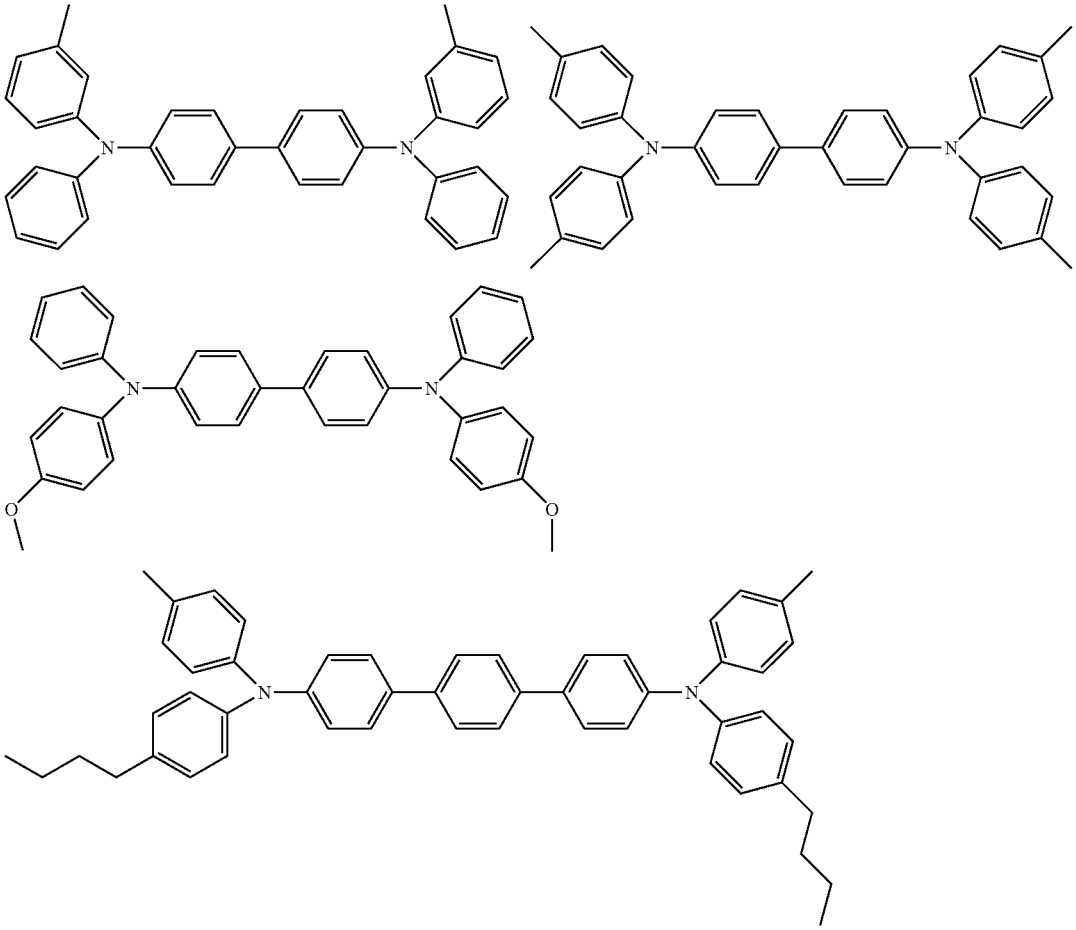

-continued

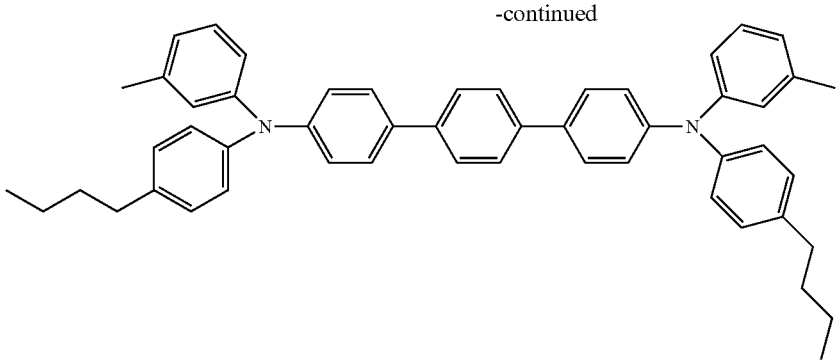

and

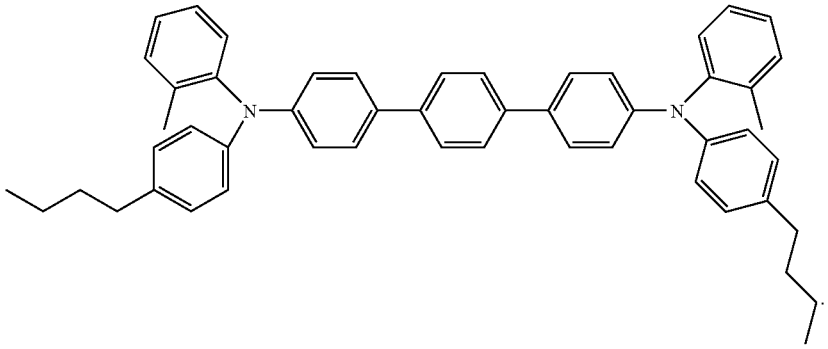

Examples of the binder materials selected for the charge transport layer or layers include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecules are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-NN'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder includes N,N'-diphenyl-N,N'-bis(3-methylphenyl)-(1,1'-biphenyl)-4,4'-diamine N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N, N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

The thickness of each of the charge transport layers in embodiments is from about 5 to about 75, from about 25 to about 50, from about 30 to about 40 microns, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 to about 5 microns. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging, and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60. Also, the overcoat layer can be comprised of a number of known suitable overcoat components.

Examples of components or materials optionally incorporated into the charge transport layer or at least one charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure.

COMPARATIVE EXAMPLE 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of tetrahydrofuran (THF) into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 3 hours. Subsequently, 2.25 grams of PCZ-200 were dissolved in 46.1 grams of tetrahydrofuran (THF), and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.50 mil. The photogenerating layer was dried at 120° C. for 1 minute in a forced air oven to form a dry photogenerating layer having a thickness of 0.8 micron.

(A) The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

(B) In another embodiment, the resulting photogenerating layer was then coated with a dual charge transport layer. The first charge transport layer was prepared by introducing into an amber glass bottle in a weight ratio of 50/50, N,N'-bis (methylphenyl)-1,1-biphenyl-4,4'-diamine (TBD) and poly (4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 14.5 microns. During this coating process, the humidity was equal to or less than 30 percent, for example 25 percent.

The above first pass charge transport layer (CTL) was then overcoated with a second top charge transport layer in a second pass. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The top layer solution was applied on the bottom layer of the charge transport layer to form a coating that upon drying (120° C. for 1 minute) had a thickness of 14.5 microns. During this coating process, the humidity was equal to or less than 15 percent.

EXAMPLE I

A photoconductor was prepared by repeating the process of Comparative Example 1 (B) except that there was included in the photogenerating layer 200 parts per million of 1,1'-dimethylferrocene, which ferrocene was added to and mixed with the prepared photogenerating layer dispersion prior to the coating thereof on the adhesive layer. More specifically, the aforementioned ferrocene additive was first dissolved in the photogenerating layer solvent of THF, and then the resulting mixture was added to the above photogenerating components. Thereafter, the mixture resulting was deposited on the adhesive layer. The ferrocene/THF solution was incorporated into the photogenerating layer dispersion at real time when the layer was coated, and on line and at the time the photoinduced discharge curve (PIDC) was to be adjusted or changed.

EXAMPLE II

A number of photoconductors are prepared by repeating the process of Example I except that there is included in the photogenerating layer in place of 1,1'-dimethylferrocene, 200 parts per million of ferrocene, 1,1'-bis(di-tert-butylphosphino)ferrocene, 1,1'-diacetylferrocene, N,N-dimethylaminomethyl ferrocene, 1,1'-dibromoferrocene, 1-hydroxyethylferrocene, or aminoferrocene.

EXAMPLE III

A photoconductor was prepared by repeating the process of Comparative Example 1 (B) except that there was included in the first charge transport layer 20 parts per million of 1,1'-dimethylferrocene, which ferrocene was added to and mixed with the prepared charge transport layer solution prior to the coating thereof on the photogenerating layer. More specifically, the aforementioned ferrocene additive was first dissolved in the charge transport layer solvent methylene chloride, and then the resulting mixture was added to the above charge transport components. Thereafter, the mixture resulting was deposited on the photogenerating layer. The ferrocene/methylene chloride solution was incorporated into the first charge transport layer solution at real time, on line, when this layer was coated, and the photoinduced discharge curve (PIDC) was to be adjusted or changed.

EXAMPLE IV

A number of photoconductors are prepared by repeating the process of Example III except that there is selected in place of the charge transport layer ferrocene, in place of 1,1'-dimethylferrocene, 20 parts per million of ferrocene, 1,1'-bis(di-tert-butylphosphino)ferrocene, 1,1'-diacetylferrocene, N,N-dimethylamino methylferrocene, 1,1'-dibromoferrocene, or 1-hydroxyethylferrocene.

Electrical Property Testing

The above prepared photoconductors of Comparative Example 1 (B), Examples I and III were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained for the above photoconductors by a series of charge-erase cycles with incrementing surface potential to generate several voltage versus charge density curves. The scanner was equipped with a scorotron set to a constant voltage charging at various surface potentials. The photoconductors were tested at surface potentials of 400 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

The results are summarized in Table 1.

TABLE 1

| | dV/dx ($Vcm^2$/erg) | V(2.2) (V) | $V_{erase}$ (V) |
|---|---|---|---|
| Comparative Example 1 (B) | −479 | 76 | 41 |
| Example I | −455 | 106 | 69 |
| Example III | −441 | 116 | 80 |

In Table 1, dV/dX (in $Vcm^2$/erg) is the photosensitivity as determined by the initial slope of the photoinduced discharge curve plotted as surface potential (in volts) versus exposure energy (in erg/$cm^2$); V(2.2) is the surface potential of the photoconductors at an exposure energy of 2.2 ergs/$cm^2$; and $V_{erase}$ is the surface potential of the photoconductors after they were subjected to an erase light of 680 nanometers at an intensity of about 100 to 150 ergs/$cm^2$.

With incorporation of the ferrocene either in the first charge transport layer (Example III) or the photogenerating layer (Example I), the PIDC was tuned to a slower value with decreased photosensitivity, increased V(2.2) and increased $V_{erase}$. For example, with 20 ppm of the ferrocene in the first charge transport layer (Example III), the photosensitivity was decreased by about 8 percent, and the V(2.2) was increased by about 40V; with 200 ppm of the ferrocene in the photogenerating layer (Example I), the photosensitivity was decreased by about 5 percent, and the V(2.2) was increased by about 30V. The incorporation of ferrocene can effectively adjust PIDC, thus providing a feasible approach for on-line tuning of the PIDC to achieve excellent photoconductor production or manufacturing yields.

Further, the yield for the Example I or III photoconductor was increased, it is believed, by about 20 percent based on theoretical calculations as compared to that of Comparative Example 1 (B) where on line tuning was not implemented.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport compound, and wherein at least one of said photogenerating layer and said charge transport layer contains a ferrocene additive present in an amount of from about 1 to about 1,000 parts per million based on the total solids of the photogenerating layer or based on the total solids of the charge transport layer.

2. A photoconductor in accordance with claim 1 wherein said ferrocene is present in an amount of from about 5 to about 500 parts per million.

3. A photoconductor in accordance with claim 1 wherein said ferrocene is present in an amount of from about 20 to about 200 parts per million based on the weight percent of the charge transport layer components.

4. A photoconductor in accordance with claim 1 wherein said ferrocene is represented by

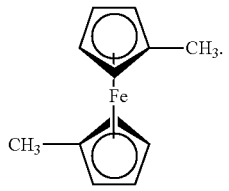

5. A photoconductor in accordance with claim 1 wherein said ferrocene is at least one of 1,1'-dimethylferrocene, ferrocene, 1,1'-bis(di-tert-butylphosphino)ferrocene, 1,1'-diacetylferrocene, N,N -dimethylaminomethyl ferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, tert-butylferrocene, and mixtures thereof.

6. A photoconductor in accordance with claim 1 wherein said ferrocene is represented by at least one of

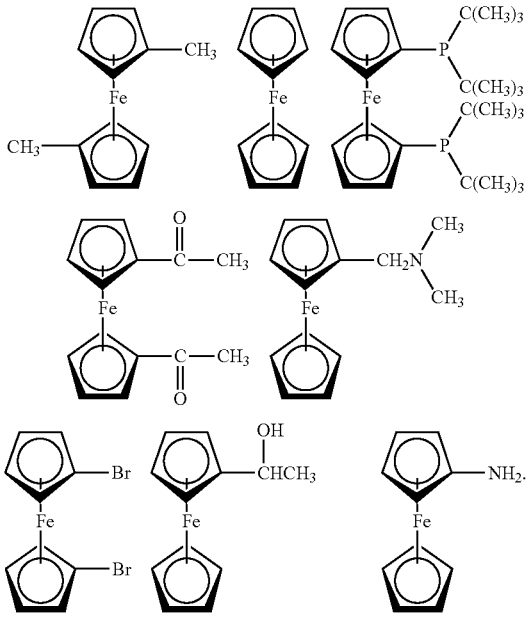

7. A photoconductor in accordance with claim 1 wherein said ferrocene is 1,1'-dimethylferrocene.

8. A photoconductor in accordance with claim 1 wherein said charge transport compound is comprised of at least one of

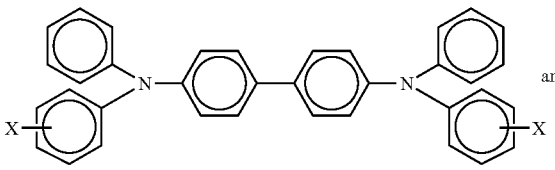

and

-continued

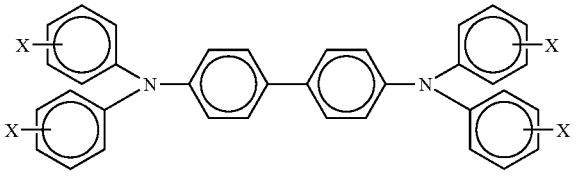

wherein X is selected from the group consisting of at least one of alkyl, alkoxy, aryl, and halogen.

9. A photoconductor in accordance with claim 1 wherein said charge transport compound is comprised of

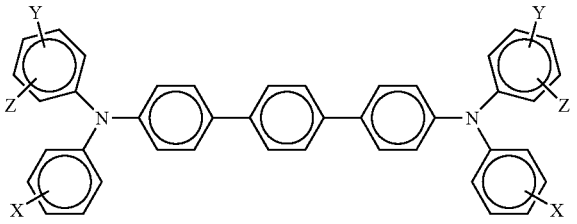

wherein X, Y and Z are independently selected from the group consisting of at least one of alkyl, alkoxy, aryl, and halogen.

10. A photoconductor in accordance with claim 1 wherein said charge transport compound is selected from the group consisting of N,N'-diphenyl-N,N-bis(3-methylphenyl)-1,1'-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl -[p-terphenyl]-4,4'-diamine, N,N'-bis(4-butylphenyl)-N,N'-di-m-toly-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-2,5-dimethylphenyl)-[p-terphenyl]-4,4'-diamine, N,N'-diphenyl-N,N'-bis(3-chlorophenyl)-[p-terpheny]-4,4'-diamine, and mixtures thereof; and wherein said at least one charge transport layer is from 1to about 4, and wherein said ferrocene is contained in said charge transport layer, and wherein said ferrocene is at least one of 1,1'-dimethylferrocene, ferrocene, 1,1'-bis (di-tert-butylphosphino) ferrocene, 1,1'-diacetylferrocene, N,N-dimethylaminomethylferrocene, 1,1-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, and tert-butylferrocene.

11. A photoconductor in accordance with claim 1 further including in at least one of said charge transport layers an antioxidant comprised of at least one of a hindered phenolic and a hindered amine, and wherein said at least one charge transport layer is from 1 to about 3, and wherein said ferrocene is 1,1'-dimethylferrocene, ferrocene, 1,1'-bis (di-tert-butylphosphino)ferrocene, 1,1'-diacetylferrocene, N,N-dimethylaminomethylferrocene, 1,1'-dibromoferrocene, 1'-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, or tert-butylferrocene.

12. A photoconductor in accordance with claim 1 wherein said photogenerating layer is comprised of at least one photogenerating pigment and said ferrocene.

13. A photoconductor in accordance with claim 12 wherein said photogenerating pigment is comprised of at least one of a perylene, a metal phthalocyanine, and a metal free phthalocyanine.

14. A photoconductor in accordance with claim 12 wherein said photogenerating pigment is comprised of at least one of chlorogallium phthalocyanine, hydroxygallium phthalocyanine, and titanyl phthalocyanine, and wherein said ferrocene is 1,1'-dimethylferrocene, ferrocene, 1,1'-bis(di-tert-butylphosphino)ferrocene, 1,1'-diacetylferrocene, N,N-dimethylaminomethyl ferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, or tert-butylferrocene.

15. A photoconductor in accordance with claim 1 further including a hole blocking layer and an adhesive layer, and wherein said ferrocene is 1,1'-dimethylferrocene, ferrocene, 1,1'-bis (di-tert-butylphosphino)ferrocene, 1,1'-diacetylferrocene, N,N-dimethylaminomethylferrocene, 1,1'-dibromoferrocene, 1-hydroxyethylferroce n e, aminoferrocene, 1,1'-dibenzoylferrocene, 1,1'-dibutyrylferrocene, benzoylferrocene, hydroxymethylferrocene, tert-amylferrocene, vinylferrocene, or tert-butylferrocene; and wherein said ferrocene is present in an amount of from about 10 to about 250 parts per million.

16. A photoconductor in accordance with claim 1 wherein said at least one charge transport layer is comprised of a top charge transport layer and a bottom charge transport layer, and wherein said top layer is in contact with said bottom layer, and said bottom layer is in contact with said photogenerating layer; and wherein at least one of said top and said bottom layer contain N,N'-diphenyl-N,N-bis(3-methylphenyl) -1,1'-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl) -N,N'-di-m-toly-[p-terphenyl]-4,4'-diamine, N,N'-bis(4-butylphenyl)-N,N'-di-o-toly-[-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)[p-terphenyl]-4,4'-diamine, N,N'-bis(4-butylphenyl)-N,N'-bis-(2,5-dimethyl)[p-terphenyl]-4,4'-diamine, N,N'-diphenyl-N,N'-bis (3-chlorophenyl)-[p-terphenyl]-4,4'-diamine, or mixtures thereof, and wherein said ferrocene is present in said bottom charge transport layer, and wherein said ferrocene is selected from the group consisting of at least one of 1,1'-dimethylferrocene, ferrocene, 1,1'-bis(di-tert-butylphosphino)ferrocene, 1,1'-diacetylferrocene, N,N-dimethylaminomethyl ferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tent-amylferrocene, vinylferrocene, and tert-butylferrocene.

17. A photoconductor consisting essentially of and in sequence of a photogenerating layer, and a charge transport layer; and wherein said charge transport layer includes a mixture of a charge transport compound and a ferrocene containing compound present in an amount of from about 20 to about 200 parts per million based on the total solids of the charge transport layer, and which ferrocene is selected from the group consisting of 1,1'-dinnethylferrocene, ferrocene, 1,1'-bis(di-tert-butylphosphino)ferrocene, 1,1'-diacetylferrocene, N,N-dimethylaminomethyl ferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, and tent-butylferrocene.

18. A photoconductor in accordance with claim 17 wherein said ferrocene is 1,1'-dimethylferrocene.

19. A photoconductor in accordance with claim 17 wherein said charge transport compound is N,N'-diphenyl-N,N-bis(3-methylphenyl)-1,1'-biphenyl-4,4'-diamine, tetra-p-tolyl-biphenyl-4,4'-diamine, N,N'-bis(4-butylpheny1)-N,N'-di-p-tolyl-[p-terphenyl]-4,4'-diamine, N,N'-bis(4-butylphenyl)-N,N'-di-m-tolyl-[p-terphen]-4,4'-diamine, N,N'-bis(4-butylphenyl)-N,N'-di-o-tolyl-ip-terphenyll-4,4'-diamine, N,N'-bis(4-butylphenyl)-N,N'-bis-(4-isopropylphenyl) -[p-terphenyl]-4,4'-diamine, N,N'-bis(4-butylphenyl)-N,N'-bis-(2-ethyl-6-methylphenyl)-[p-terphenyl]-4,4'-diamine, N,N'-bis (4-butylphenyl)-N,N'-bis-(2,5-dimethylphenyl)-[p-terphenyl]-4,4'-diamine, or N,N'-diphenyl-N,N'-bis(3-chlorophenyl)-[p-terphenyl]-4,4'-diamine, and wherein said ferrocene is present in an amount of from about 20 to about 40 parts per million.

20. A photoconductor in accordance with claim 17 wherein said ferrocene is 1,1'-dimethylferrocene.

21. A photoconductor comprising a supporting substrate, a photogenerating layer, and a charge transport layer, wherein said photogenerating layer is comprised of at least one photogenerating pigment and a ferrocene containing component present in an amount of from about 50 to about 600 parts per million based on the total solids of the photogenerating layer and which ferrocene is selected from the group consisting of 1,1'-dimethylferrocene, ferrocene, 1,1'-bis (di-tert-butylphosphino)ferrocene, 1,1'-diacetylferrocene, N,N-dimethylaminomethyl ferrocene, 1,1'-dibromoferrocene, 1-hydroxyethylferrocene, aminoferrocene, 1,1'-dibenzoylferrocene, 1,1'-dibutyrylferrocene, benzoylferrocene, hydroxymethylferrocene, tert-amylferrocene, vinylferrocene, and tert-butylferrocene, and wherein said charge transport layer contains a compound as represented by the following formulas/structures, wherein X is selected from the group consisting of at least one of alkyl, alkoxy, aryl, and halogen

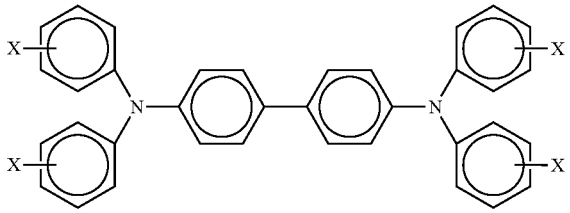

and

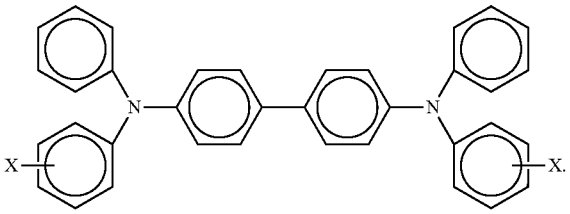

22. A photoconductor in accordance with claim 21 wherein said ferrocene is 1,1'-dimethylferrocene, ferrocene.

23. A photoconductor in accordance with claim 21 wherein said charge transport layer is a hole transport layer, and said photogenerating layer and said charge transport layer each further contains a resin binder.

24. A photoconductor in accordance with claim 21 wherein said photogenerating pigment is a hydroxygallium phthalocyanine.

25. A photoconductor in accordance with claim 21 wherein said charge transport layer is comprised of a top charge transport layer and a bottom charge transport layer; and wherein said top and said bottom charge transport layer contains from about 10 to about 75 percent by weight of a charge transport compound.

26. A photoconductor in accordance with claim 25 wherein said ferrocene is 1,1'-dimethylferrocene.

* * * * *